United States Patent [19]

Rock

[11] Patent Number: 4,708,122

[45] Date of Patent: Nov. 24, 1987

[54] ALCOHOL OUTDOOR PORTABLE STOVE AND ACCESSORIES

[76] Inventor: Henry L. Rock, 2576 S. Van Dyke, Marlette, Mich. 48453

[21] Appl. No.: 859,380

[22] Filed: May 5, 1986

[51] Int. Cl.[4] ..... F24C 5/00

[52] U.S. Cl. ..... 126/43; 126/4; 126/208; 126/45; 126/276; 99/339

[58] Field of Search ..... 126/4, 6, 9 R, 9 B, 126/37 R, 38, 43, 44, 45, 50, 59.5, 265, 204, 208, 274, 276, 271.1, 271.3; 99/339, 450

[56] References Cited

U.S. PATENT DOCUMENTS

| | | | |
|---|---|---|---|
| 1,524,961 | 2/1925 | Asche | 126/38 |
| 1,709,289 | 4/1929 | Tatum | 126/29 |
| 2,573,772 | 11/1951 | Nysten | 126/30 X |
| 2,677,363 | 5/1954 | Bryan | 126/4 |
| 3,062,127 | 11/1962 | Lang | 126/38 X |
| 3,263,979 | 8/1966 | Muckelrath | 126/59.5 |
| 3,520,290 | 7/1970 | Winters | 126/25 |
| 3,970,141 | 7/1976 | Raether | 126/19.5 X |
| 3,978,782 | 9/1976 | Werling | 126/43 X |
| 4,131,107 | 12/1978 | Godbout | 126/9 R X |
| 4,204,516 | 5/1980 | Figura | 126/9 R |

*Primary Examiner*—Margaret A. Focarino

[57] ABSTRACT

An alcohol outdoor portable stove for hunters and fisherman comprising a hollow firebox with a cutaway portion in the front wall thereof for allowing escape of heat forwardly of the stove, a removeable front panel which covers the cutaway portion and a hinged lid for the top of the stove, an alcohol container, an arrangement inside the firebox on the floor thereof for supporting the container in an upright position to prevent accidental tipping over thereof and a manually operable heat regulator for controlling the air supply to the container for regulating the heat put out by the stove, whereby, upon lighting of the alcohol in the container, heat in copious amount will escape from in front of the stove and provide ample warmth for the hunter or fisherman.

8 Claims, 5 Drawing Figures

Fig-1
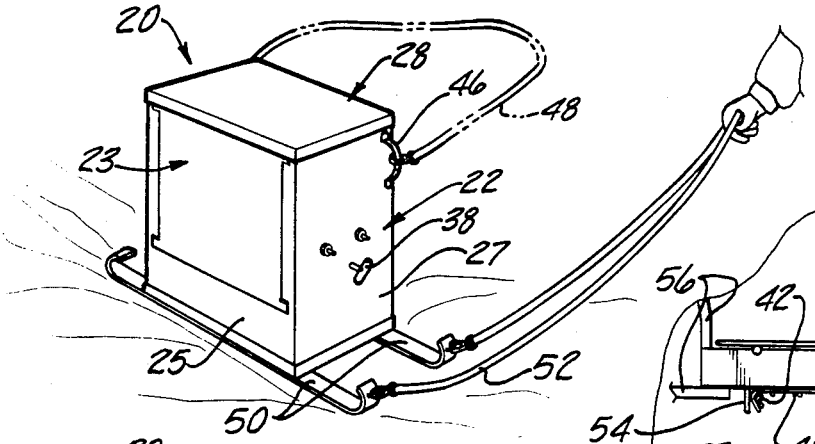
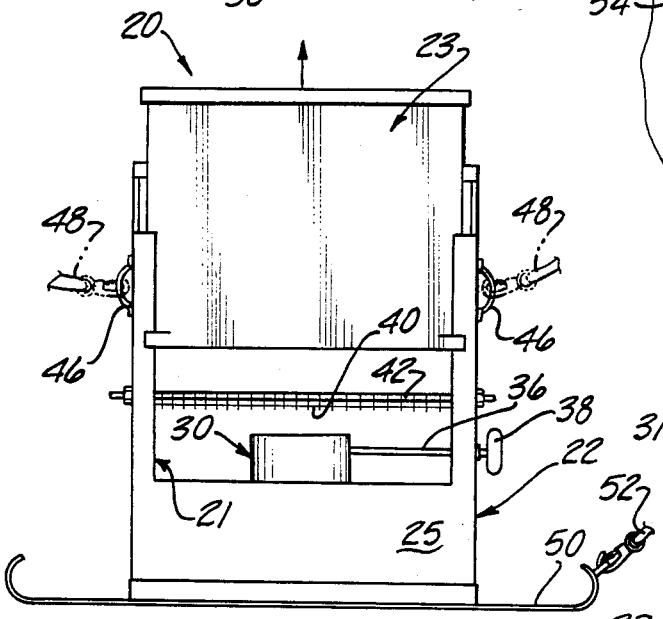
Fig-2
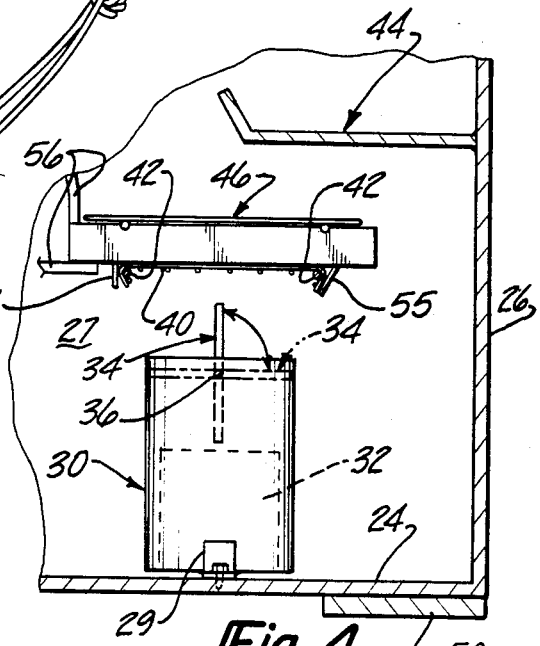
Fig-4
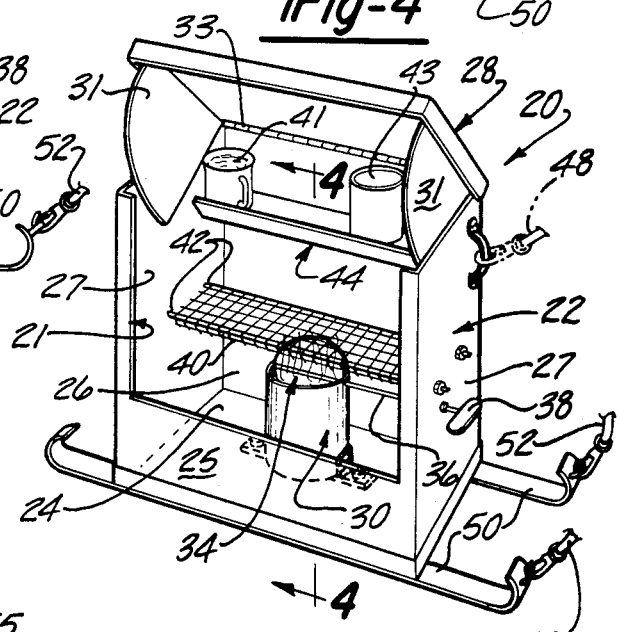
Fig-3
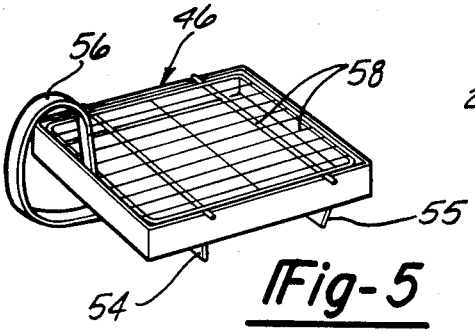
Fig-5

ALCOHOL OUTDOOR PORTABLE STOVE AND ACCESSORIES

My invention relates to an alcohol outdoor portable stove and has for its object the provision of such a stove for the use of hunters and ice fisherman.

The foregoing object of my invention, and the advantages thereof, will become apparent during the course of the following description, taken in conjunction with the accompanying drawings, in which:

BRIEF DESCRIPTION OF THE DRAWINGS

FIG. 1 is a perspective view of an alcohol outdoor portable stove embodying my invention;

FIG. 2 is a front-elevational view thereof with the front panel thereof being removed;

FIG. 3 is a perspective view thereof with the front panel removed and with the lid thereof in its elevated position;

FIG. 4 is a vertical sectional view of the structure of FIG. 3 taken on the line 4—4 thereof; and FIG. 5 is a perspective view of an accessory for said stove.

DETAILED DESCRIPTION OF PREFERRED EMBODIMENT

Referring to the drawings in greater detail, 20 generally designates said alcohol outdoor stove which comprises a sheet metal body 22 fabricated into a hollow rectangular firebox having a bottom wall 24, front and back walls 25 and 26, respectively, and side walls 27. A lid 28 is provided for the firebox which is hinged, as at 33, to the back wall 26. Side panels 31 are provided for the lid 28 and are moveable therewith to direct the heat of the stove 20 forwardly and to hinder sideways escape thereof. The front wall 25 has a cutaway portion 21 formed therein which allows heat to escape in large volume from the front of the body 22. A front panel 23 closes off said cutaway portion 21 when the stove 20 is not in use. As shown in FIGS. 1 and 2, the front panel 23 is provided with four corner tabs as shown, and slides up and down with its side edges inside the firebox 22 and with the corner tabs outside thereof. The front edges of the lid 28 fits over the top edge of the front panel 23. A removeable sheet metal alcohol container 30 (having a replaceable wick 32 therein) is made fast to detents 29 or a strap bolted to the bottom wall 24 so that said container 30 stands upright and cannot be accidentally tipped over. A heat regulator 34 is provided for the fuel container 30 consisting of a rotatable butterfly valve for controlling the air supply to the alcohol within the container 30. The regulator or valve 34 is made fast to one end of a rod 36 which extends through a side wall 27 and has its other end joined in a handle 38 for manually rotating the valve 34. Above the fuel container 30 a screen 40 is provided to serve as a cooking grill. The screen or grill 40 is supported a half unit above the fuel container (a full unit being the height of said fuel container) on a pair of rods 42 mounted in the side walls 27, as shown. The grill 40 has downwardly and inwardly bent front and rear edges, as shown, which hold it in place on the rods 42. Above and behind the grill 40, a shelf 44 is provided to serve as a holding tray for cups 41 and cooking utensils 43. The shelf 44 is mounted a half unit above the grill 40 and rearwardly thereof since it is affixed to the back wall 26, as shown. Carrying handles 46 are provided for carrying the stove 20 and are mounted at the top rear of the side walls 27, as shown. A rope 48 may be affixed to the handles 46 to assist in carrying the stove 20. The rope 48 can also serve as a deer drag. The firebox 22 is removeably mounted on a pair of skis 50 for pulling the stove 20 over ice or snow in lieu of carrying it. A pull rope 52 is removeably affixed, as shown, to the front of the skis 50. An accessory for the stove 20 is provided in the form of a rectangular frying pan 46 having a handle 56 and a removeable screen or grid 58 therefor. Affixed to the outside surface of the bottom of the frying pan 46 are downwardly projecting front and back walls 54 and 55, respectively, which force fit over the grill 40 and serve to hold the frying pan 46 in place thereon. The wall 55 is bent to project rearwardly as well as downwardly as shown in FIG. 4 to better grip the grill 40.

In use of the stove 20, the skis 50 and pull rope 52 are employed if there is snow or ice and the stove 20 is pulled over same to its place of use. Otherwise, the skis 50 and pull rope 52 are removed and the stove 20 is carried, via the handles 46 and with or without the aid of the rope 48, to its place of use. The front panel 23 is removed and the lid 28 is raised and alcohol is poured into the container 30 to cover the wick 32 therein. The alcohol is then ignited and heat will be generated immediately and in copious amount which will escape from in front of the stove and provide ample warmth for the hunter or fisherman. The hunter or fisherman can cook on the grill 40 and use the frying pan 46 and the shelf 44 as desired.

A savings in energy is realized with the stove 20 by reason of the open flame which it safely contains and the directing of the heat forwardly out of the front of the stove by the rear and side walls and side-paneled lid thereof.

It will thus be seen that there has been provided by my invention an alcohol outdoor portable stove and accessories therefor in which the object hereinabove set forth, together with many thoroughly practical advantages, has been successfully achieved. While a preferred embodiment of my invention has been shown and described, it is to be understood that variations and changes may be resorted to without departing from the spirit of my invention as defined by the appended claims.

What I claim is:

1. An alcohol outdoor portable stove for hunters and fisherman comprising a hollow firebox having a bottom wall, front and backwalls and sidewalls with a cutaway portion in the front wall thereof for allowing escape of heat forwardly of said stove, a removeable front panel for said stove which mounts on the front wall thereof and covers said cutaway portion, said panel having means for allowing sliding movement up and down in said cutaway portion, a hinged lid for the top of the stove having a front edge, said front edge fitting over the top edge of said front panel in its closed position, an alcohol container, means inside the firebox on the bottom wall thereof for supporting said container in an upright position to prevent accidental tipping over thereof, a heat regulator mounted on said alcohol container with a manually operable rod attached thereto and extending through a sidewall of said firebox for controlling the air supply to said container for regulating the heat put out by said stove, side panels mounted to the underside of said lid and moveable therewith so as to be accomodated in the firebox when said lid is closed and which prevent lateral heat excape from said stove when the lid is in its open position whereby, upon lighting of the alcohol in said container, heat in copious amounts will escape from the front of the stove and provide ample warmth for the hunter or fisherman.

2. An alcohol outdoor portable stove as claimed in claim 1 further comprising a grill and means for supporting said grill disposed above said alcohol container.

3. An alcohol outdoor portable stove as claimed in claim 2 in which the grill consists of a removeable screen held on a pair of rods mounted in the sidewalls of said firebox.

4. An alcohol outdoor portable stove as claimed in claim 3 in which the front and rear edges of said screen are bent downwardly and inwardly to better hold same on said rods.

5. An alcohol outdoor portable stove as claimed in claim 4 further comprising a shelf disposed above said grill.

6. An alcohol outdoor portable stove as claimed in claim 4, said shelf supported on a back wall of said firebox.

7. An alcohol outdoor portable stove as claimed in claim 2 having an accessory comprising a frying pan having means projecting from the underside therefor for holding same on said grill.

8. An alcohol outdoor portable stove as claimed in claim 7 in which said frying pan has front and rear walls projecting downwardly from the underside surface thereof, the rear wall being straight and the front wall being bent inwardly as well as downwardly to better hold the frying pan on said grill.

* * * * *